US008057181B1

(12) United States Patent
Liang

(10) Patent No.: US 8,057,181 B1
(45) Date of Patent: Nov. 15, 2011

(54) MULTIPLE EXPANSION FILM COOLING HOLE FOR TURBINE AIRFOIL

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 538 days.

(21) Appl. No.: 12/267,167

(22) Filed: Nov. 7, 2008

(51) Int. Cl.
*F01D 5/18* (2006.01)

(52) U.S. Cl. ..... 416/97 R

(58) Field of Classification Search ..... 416/97 R, 416/97 A

See application file for complete search history.

(56) References Cited

U.S. PATENT DOCUMENTS 4,653,983 A 3/1987 Vehr
4,684,323 A 8/1987 Field
4,738,588 A 4/1988 Field
5,382,133 A 1/1995 Moore et al.
5,609,779 A 3/1997 Crow et al.
6,183,199 B1 2/2001 Beeck et al.
6,368,060 B1 * 4/2002 Fehrenbach et al. ..... 416/97 R
6,869,268 B2 3/2005 Liang
6,918,742 B2 7/2005 Liang
7,019,257 B2 * 3/2006 Stevens ..... 219/121.71
7,328,580 B2 2/2008 Lee et al.
7,374,401 B2 5/2008 Lee

* cited by examiner

*Primary Examiner* — Chandra Chaudhari
(74) *Attorney, Agent, or Firm* — John Ryznic

(57) ABSTRACT

A film cooling hole for a turbine airfoil used in a gas turbine engine, where the film cooling hole is formed from a laser with smooth surfaces and without sharp corners, the film hole having a metering section of constant diameter, a first diffusion section having a conical shape, and a spreading section having a contoured clam shell cross sectional shape that opens onto the airfoil surface. The contoured clam shell shaped spreading section includes a raised middle portion with depressions on both sides, and slanted side walls that slant toward the hole opening. The laser cut film cooling hole can be formed after the TBC has been applied.

16 Claims, 7 Drawing Sheets

View A-A

MULTIPLE EXPANSION FILM COOLING HOLE FOR TURBINE AIRFOIL

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to a film cooling hole for a turbine airfoil.

2. Description of the Related Art Including Information Disclosed Under 37 CFR 1.97 and 1.98

Airfoils used in a gas turbine engine, such as rotor blades and stator vanes (guide nozzles), require film cooling of the external surface where the hottest gas flow temperatures are found. The airfoil leading edge region is exposed to the highest gas flow temperature and therefore film cooling holes are used here. Film cooling holes discharge pressurized cooling air onto the airfoil surface as a layer that forms a blanket to protect the metal surface from the hot gas flow. The prior art is full of complex film hole shapes that are designed to maximize the film coverage on the airfoil surface while minimizing loses.

Film cooling holes with large length to diameter ratio are frequently used in the leading edge region to provide both internal convection cooling and external film cooling for the airfoil. For a laser or EDM formed cooling hole, the typical length to diameter is less than 12 and the film cooling hole angle is usually no less than 20 degrees relative to the airfoil's leading edge surface. FIGS. 1 and 2 show a prior art film cooling hole with a large length to diameter (L/D) ratio as discloses in U.S. Pat. No. 6,869,268 B2 issued to Liang on Mar. 22, 2005 and entitled COMBUSTION TURBINE WITH AIRFOIL HAVING ENHANCED LEADING EDGE DIFFUSION HOLES AND RELATED METHODS. In order to attain the same film hole breakout length or film coverage, the straight circular showerhead hole has to be at around 14 degrees relative to the airfoil leading edge surface. This also results in a length to diameter ration of near 14. Both the film cooling hole angle and L/D exceed current manufacturing capability.

The Liang U.S. Pat. No. 6,869,268 also shows a one dimension diffusion showerhead film cooling hole design which reduces the shallow angle required by the straight hole and changes the associated L/D ratio to a more producible level. This film cooling hole includes a constant diameter section at the entrance region of the hole that provides cooling flow metering capability, and a one dimension diffusion section with less than 10 degrees expansion in the airfoil radial inboard direction. As a result of this design, a large film cooling hole breakout is achieved and the airfoil leading edge film cooling coverage and film effectiveness level is increased over the FIG. 1 straight film cooling hole.

For an airfoil main body film cooling, a two dimensional compound shaped film hole as well as a two dimensional shaped film cooling hole with curved expansion is utilized to enhance film coverage and to minimize the radial over-expansion when these cooling holes are used in conjunction with a compound angle. U.S. Pat. No. 4,653,983 issued to Vehr on Mar. 31, 1987 and entitled CROSS-FLOW FILM COOLING PASSAGE and U.S. Pat. No. 5,382,133 issued to Moore et al on Jan. 17, 1995 and entitled HIGH COVERAGE SHAPED DIFFUSER FILM HOLE FOR THIN WALLS both disclose this type of film cooling hole.

A three dimensional diffusion hole in the axial or small compound angle and variety of expansion shape was also utilized in an airfoil cooling design for further enhancement of the film cooling capability U.S. Pat. No. 4,684,323 issued to Field on Aug. 4, 1987 and entitled FILM COOLING PASSAGES WITH CURVED CORNERS and U.S. Pat. No. 6,183,199 B1 issued to Beeck et al on Feb. 6, 2001 and entitled COOLING-AIR BORE show this type of film hole.

Another improvement over the prior art three dimensional film hole is disclosed in U.S. Pat. No. 6,918,742 B2 issued to Liang on Jul. 19, 2005 and entitled COMBUSTION TURBINE WITH AIRFOIL HAVING MULTI-SECTION DIFFUSION COOLING HOLES AND METHODS OF MAKING SAME. This multiple diffusion compounded film cooling hole starts with a constant diameter cross section at the entrance region to provide for a cooling flow metering capability. The constant diameter metering section is followed by a 3 to 5 degree expansion in the radial outward direction and a combination of a 3 to 5 degree followed by a 10 degree multiple expansions in the downstream and radial inboard direction of the film hole. There is no expansion for the film hole on the upstream side wall where the film cooling hole is in contact with the hot gas flow.

FIG. 5 shows a prior art film cooling hole that passes straight through the airfoil wall at a constant diameter and exits at an angle to the airfoil surface. Some of the cooling air is ejected directly into the mainstream causing turbulence, coolant dilution and a loss of downstream film effectiveness. Also, the hole breakout in the stream-wise elliptical shape will induce a stress problem in the blade. As seen in FIG. 5, the space between adjacent film holes is left uncovered by the film layer being ejected from the holes.

The prior art EDM formed diffusion film hole has an expansion radial and rearward hole surfaces curved toward both the airfoil trailing edge and spanwise directions. Coolant penetration into the gas path is thus minimized, yielding good build-up of the coolant sub-boundary layer next to the airfoil surface, a lower aerodynamic mixing loss due to a low angle of cooling air ejection, a better film coverage in the spanwise direction and a high film effectiveness for a longer distance downstream of the film hole. Since the film cooling hole breakout contains sharp corner on the airfoil surface, stress concentration becomes a major concern for this particular film cooling hole geometry. FIGS. 6 and 7 show a stream-wise film cooling of the prior art, and FIG. 8 shows the compound film hole of the prior art with the EDM formed holes.

As the TBC property improves and more turbine components utilize a TBC to lower the airfoil metal temperature, less cooling air is required to cool the airfoil. Then, the manufacture of the film cooling hole with the use of a laser machining process becomes more popular. The elimination of the EDM formed film cooling hole will save eliminate the steps of masking the film cooling holes prior to the application of the TBC and the required clean-up of the masking material after the TBC is applied. These steps are required due to the Electrode used in the EDM process cannot cut through the TBC material. Also, a well-defined edge becomes difficult to produce with a laser. Therefore, a continuous smooth surface will be easier to form using a laser beam to cut through the TBC and the airfoil metal materials.

BRIEF SUMMARY OF THE INVENTION

It is an object of the present invention to provide for a turbine airfoil with a film cooling hole that can be fanned without the need for applying masking material prior to applying the TBC to the airfoil surface.

It is another object of the present invention to provide for a film cooling hole that can be formed in the airfoil after the TBC has been applied.

It is another object of the present invention to provide for a film cooling hole than can be formed from a laser machining process.

It is another object of the present invention to provide for a film cooling hole that can be formed without sharp corners to eliminate stress concentration.

It is another object of the present invention to provide for a film cooling hole to provide better film coverage than the cited prior art film cooling holes.

It is another object of the present invention to provide for a film cooling hole with an opening that will re-distribute the film flow distribution more on both corners of the hole than in the middle of the hole.

It is another object of the present invention to provide for a film cooling hole that will minimize the vortex formation under the film ejection location to establish a better film layer next to the airfoil surface.

The film cooling hole of the present invention includes a constant diameter metering section followed by a conical first diffusion section and then a second diffusion section that functions as a spreader of the film cooling air. The second diffusion section has a contoured clam shell shaped cross sectional area with a raised lower middle portion on the downstream side wall to force the cooling air against the two sides for a better film flow distribution. The geometry of the film cooling hole allows for a laser machining process to be used to create the hole, and thus the film holes can be formed after the TBC has been applied and the sharp corners can be eliminated.

DETAILED DESCRIPTION OF THE INVENTION

The film cooling hole of the present invention is disclosed for use in a turbine airfoil, such as a rotor blade or a stator vane, in order to provide film cooling for the airfoil surface. However, the film cooling hole can also be used for film cooling of other turbine parts such as the combustor liner, or other parts that require film cooling for protection against a hot gas flow over the surface outside of the gas turbine engine field.

Figure 1:
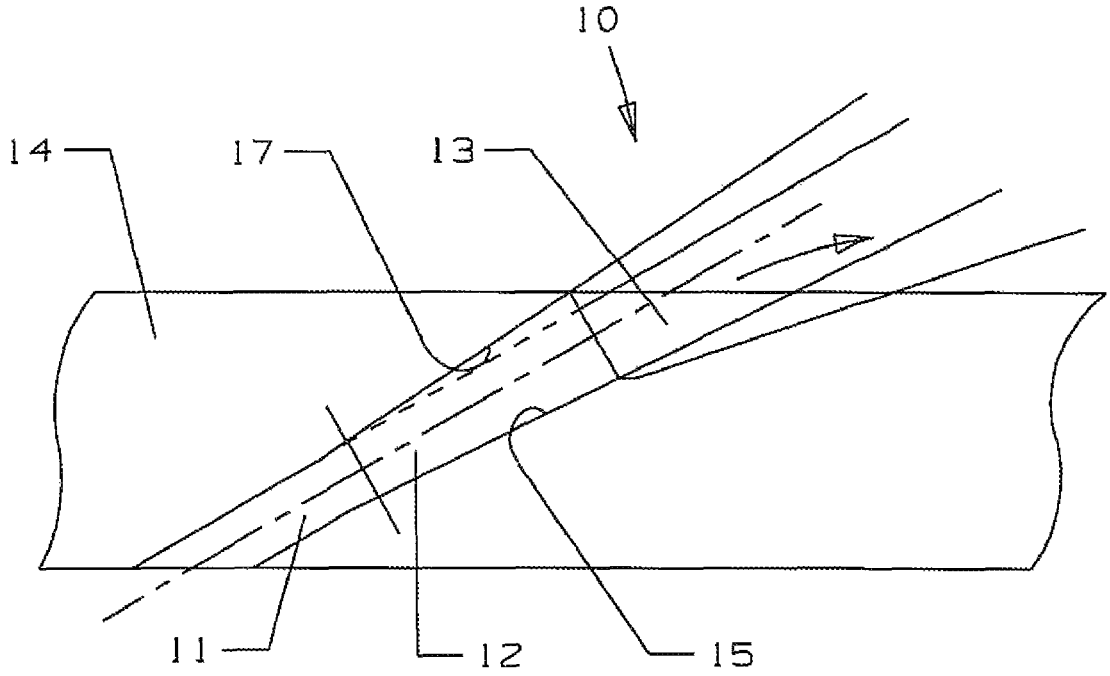
FIG. 1 shows a cross section side view of the film cooling hole of the present invention.

The film cooling hole of the present invention is shown in FIG. 1 that forms a multiple expansion conical film cooling hole 10 that includes three sections. The first section is a constant diameter section 11 forms a metering section at the inlet to meter the flow of cooling an into the film cooling hole 10. The second section 12 is a first expansion section that produces expansion in three dimensions along the downstream wall 15, the upstream wall 17 and the two side walls 16 (see FIG. 4) formed by a series of circles with increasing diameter in the direction of the air flow. The first diffusion section has a conical shape with the axis slightly offset from the axis of the metering section in the upstream side wall direction. The third section 13 is a second expansion section and is formed as a contoured clam shell geometry to produce a further expansion as well as a film flow distribution. By contoured clam shell, this application means that the cross sectional shape of the hole has a top side, two sides, and a bottom side with a raised portion in the middle, and where the sides merge smoothly without sharp corners such as the view seen in FIG. 2. The third section 13 or the second diffusion section 13 can also be referred to as a spreading section since it spreads out the film cooling air as the air discharges from the contoured clam shell shaped hole opening.

Figure 2:
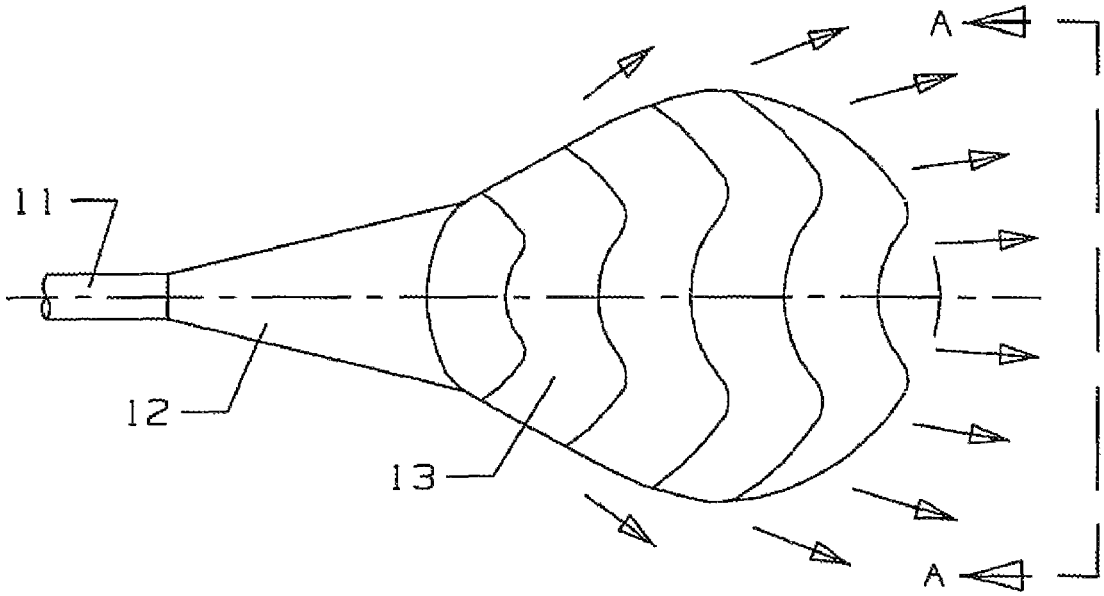
FIG. 2 shows a cross section top view of the film cooling hole of the present invention.
Figure 3:
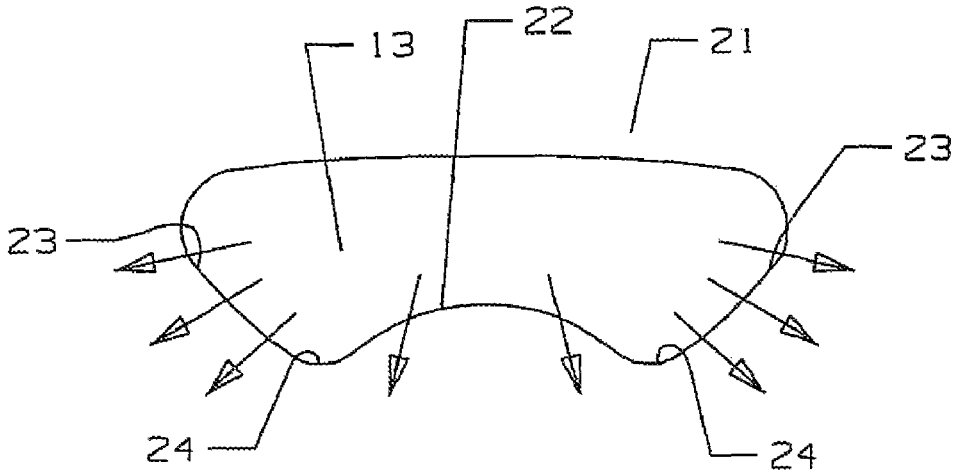
FIG. 3 shows a front view of the opening of the film cooling hole of FIGS. 1 and 2.
Figure 4:
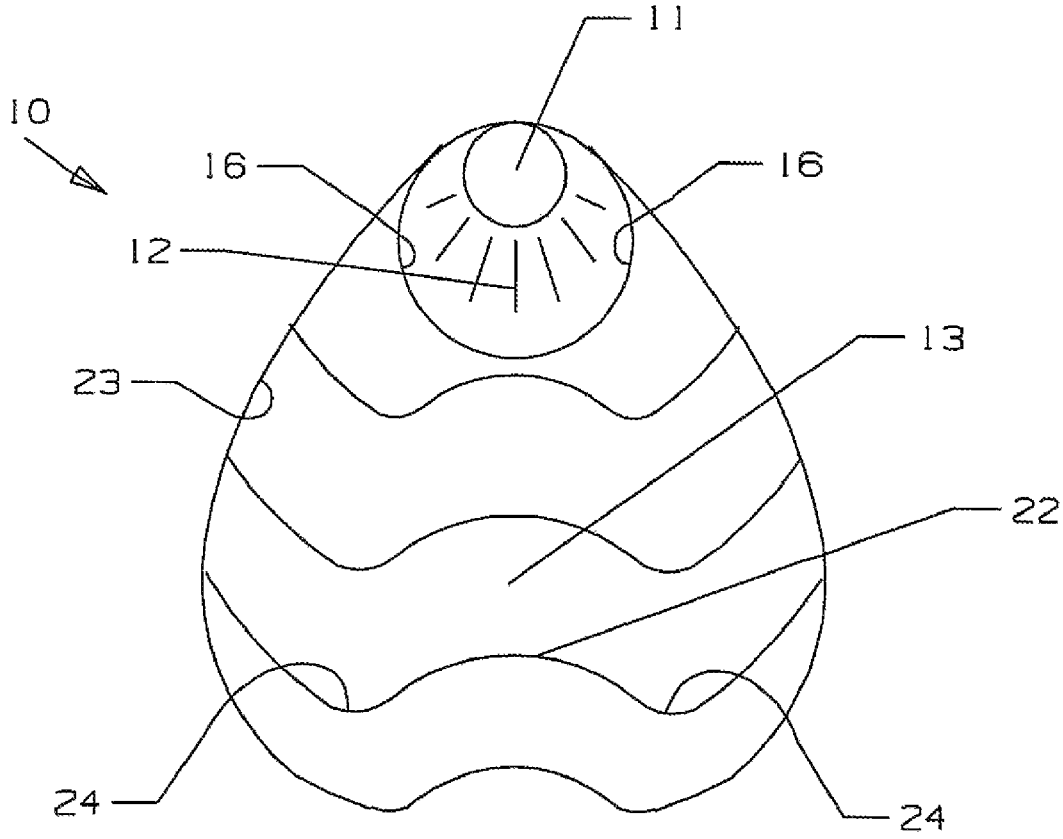
FIG. 4 shows a front view of the film cooling hole looking down through the opening and into the metering inlet section of the film cooling hole of the present invention.
Figure 5:
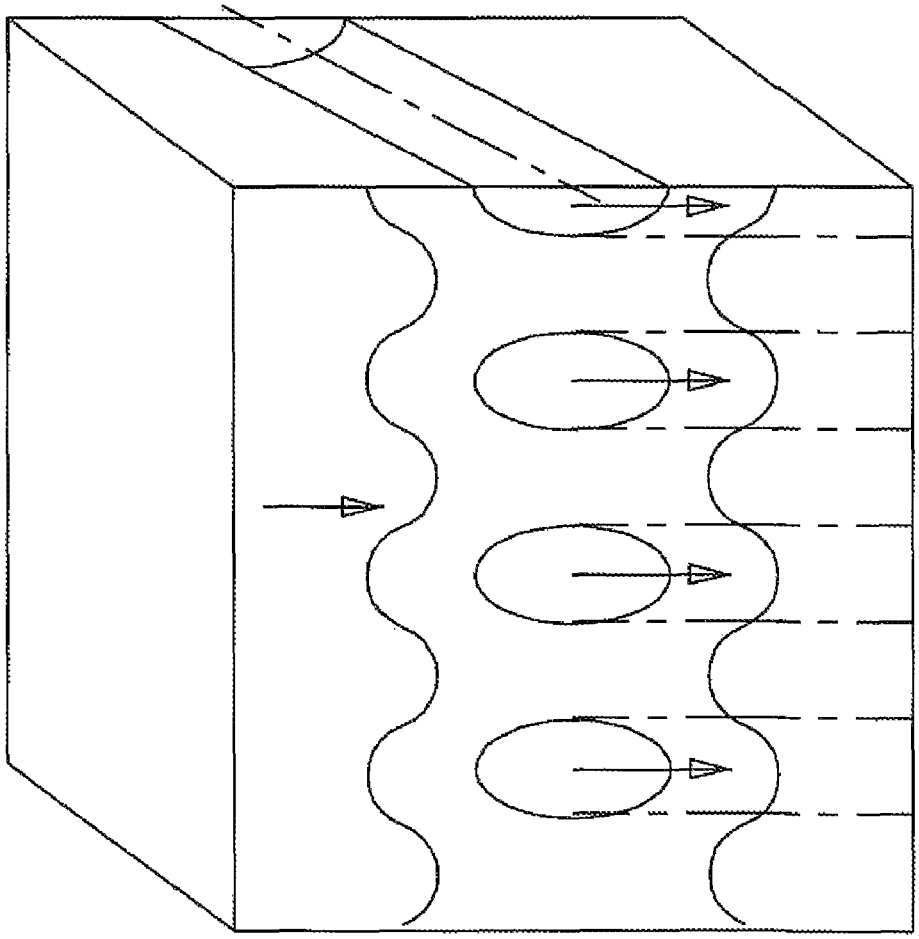
Fig 5 Prior Art
FIG. 5 shows a schematic view of a prior art film cooling hole of the straight type.
Figure 6:
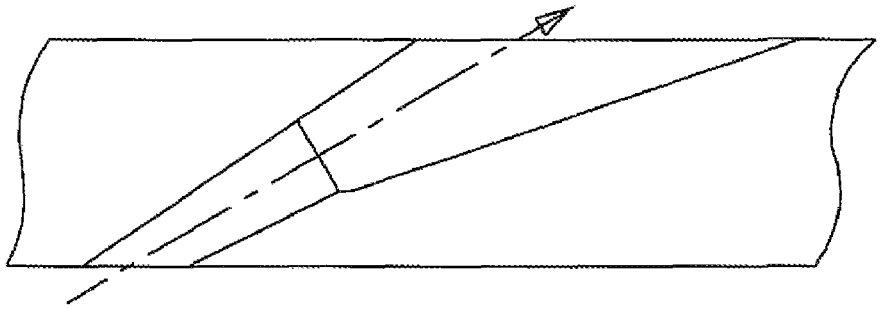
Fig 6 Prior Art
FIG. 6 shows a cross section side view of the film cooling hole of the prior art with a downstream wall expansion.
Figure 7:
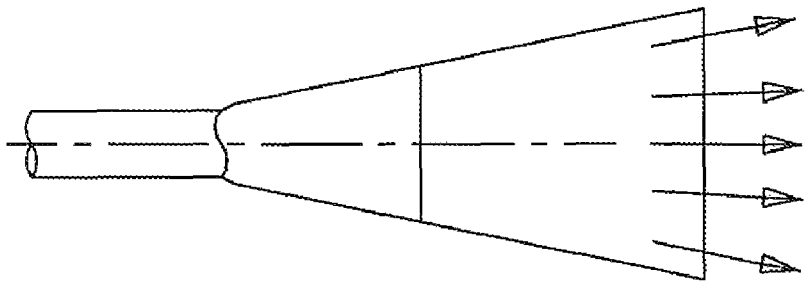
Fig 7 Prior Art
FIG. 7 shows a cross section top view of the prior art film cooling hole with expansion on both sidewalls.
Figure 8:
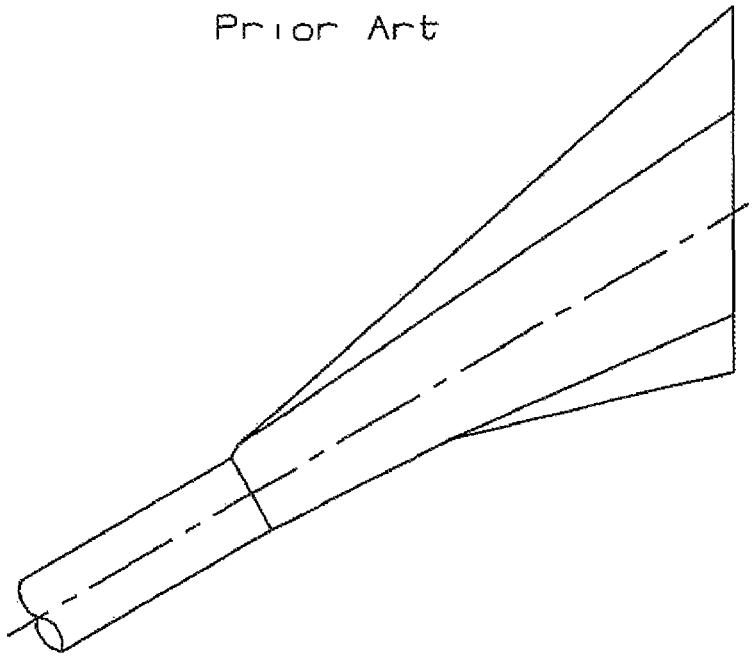
Fig 8 Prior Art
FIG. 8 shows a prior art film cooling hole of the compound shaped film hole.

The contoured clam shell section 13 opens onto the surface of the airfoil 14 and includes a cross sectional shape as seen in FIG. 3 with a top wall 21 that is the end of the upstream wall of the second section 12, two side walls 23 that are slanted outward toward the hole opening, a bottom wall with a raised middle wall section 22 and two depressions or lower wall sections 24 formed between the raised wall section 22 and the slanted side wall 23. FIG. 2 shows a cross section view of the film hole from the top with the contoured clam shell section 13 opening onto the surface of the airfoil and its cross section. FIG. 4 shows the film cooling hole 10 looking down the throat with the metering section 11 at the bottom, the first diffusion section 12 formed by the circular cross sectional shaped walls 15 and 16, and the second diffusion section 13 with the contoured clam shell geometry.

The cross sectional area of the inlet for the first diffusion section 12 is A1 and the cross sectional area of the outlet for the first diffusion section is A2, and the ratio of A2 to A1 is from 2 to 6 for this particular embodiment of the film cooling hole 10. The top wall or upstream wall 17 expands from 5 to 15 degrees outward. The bottom wall or the downstream wall 22 and 24 of the contoured clam shell expansion expands at 10 to 20 degrees.

The contoured clam shell configuration provides for the cooling air to spread out in the multiple directions. This will allow for the spanwise expansion of the stream-wise oriented flow to combine the best aspects of both spanwise and stream-wise film cooling holes. The benefit of utilizing this particular film hole is described below. The film hole 10 of the present invention can be formed in the airfoil wall with a laser instead of the EDM process used in the prior art. Because the film hole is formed from a laser, the hole can be formed after the TBC has been applied and the laser will cut through the metal and the TBC without the need to use masking. A well defined edge or corner is difficult to produce with a laser, so the rounded holes in the three sections are easily produced with the laser. The laser produces a continuous and smooth surface around the cross sectional areas of the hole sections. Thus, because the inlet section and the two diffusion sections have rounded shaped cross sections instead of the sharp corners formed by the EDM process, it will be easy to form the hole with a laser machining process. The contoured clam shell section does not have to be in a flat geometry. The contoured clam shell geometry can be cut by the laser machine in a continuous smooth contour for both the corners and the middle surface. A full circular metering section 11 followed by a conical shaped first diffusion section and a wavy shaped contoured clam shell second diffusion section is thus formed for the construction of the laser machined shaped film cooling hole of the present invention. The elimination of sharp corners will reduce the stress concentration factor and improve the life of the airfoil having the film holes therein.

Figure 9:
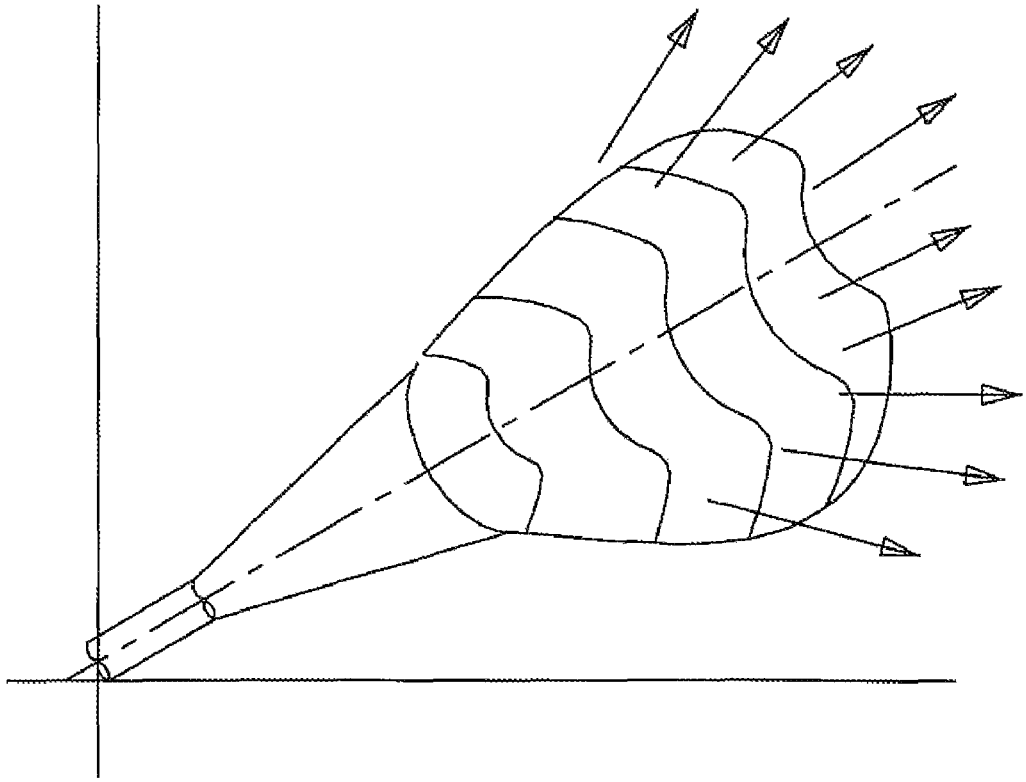
FIG. 9 shows a cross section view of a film cooling hole of the present invention in a compound shaped configuration.
Figure 10:
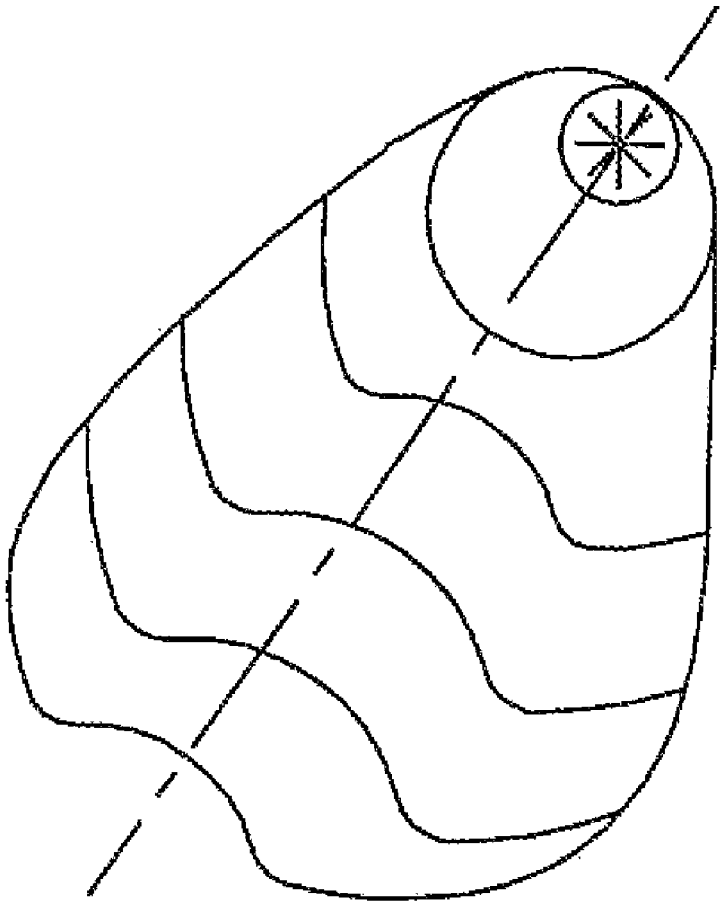
FIG. 10 shows a view of the film cooling hole of FIG. 9 looking down the hole into the metering inlet section.

A second embodiment of the contoured clam shell film cooling hole is shown in FIGS. 9 and 10 in which the hole 10 is used in a compound angled application.

Advantages of the film hole formed by a laser with the geometry disclosed above are as follows. Laser machining of the film cooling hole can cut through the TBC and the airfoil metal at the same time, and therefore eliminates the need for masking the hole during the TBC applying step in the EDM formed holes. Drilling after applying the TBC coating reduces the coat-down cooling flow uncertainty. Laser machining reduces the cost of the film cooling hole formation. Elimination of sharp corners will enable the laser machining of the film holes to be faster and cheaper than the EDM process. Replace the sharp corners within the film cooling hole with a continuous expansion conical hole to eliminate the internal flow separation within the film cooling hole. Multiple expansions produce a better film coverage and thus improve the film effectiveness level for the hole. Multiple direction expansion enables a wider angle to spread the cooling air which results in a higher film coverage on the airfoil surface. The use of a contoured clam shell geometry to spread out the film cooling flow allows for the secondary flow migration on the blade surface for radial outward or radial inward directions. The multiple expansion film cooling injects cooling air at a lower angle than the standard shaped hole that yields a smaller true surface angle for the film cooling air and produces a better film layer and a higher film effectiveness level. The exit contoured clam shell need not be eccentric with the conical hole in order to redistribute film cooling flow in a compound angled application.

I claim the following:

1. A film cooling hole for use on an airfoil surface of a gas turbine engine in which the airfoil surface is exposed to a hot gas flow, the film cooling hole comprising:

a metering section to meter a flow of cooling air into the film cooling hole;

a first diffusion section located downstream from the metering section;

a second diffusion section located downstream from the first diffusion section, the second diffusion section having a contoured clam shell cross sectional shape opening onto the airfoil surface.

2. The film cooling hole of claim 1, and further comprising:

the second diffusion section has a contoured clam shell cross sectional shape from an outlet of the first diffusion section to the hole opening.

3. The film cooling hole of claim 1, and further comprising:

the contoured clam shell cross sectional shape includes a raised middle section and two depressions formed on the sides of the raised middle section on the downstream wall surface of the film cooling hole.

4. The film cooling hole of claim 1, and further comprising:

the contoured clam shell cross sectional shape includes two side walls slanted outward.

5. The film cooling hole of claim 1, and further comprising:

the first diffusion section has a conical shape from the inlet to the outlet of the section.

6. The film cooling hole of claim 1, and further comprising:

the film cooling hole is formed by a laser and without sharp corners.

7. The film cooling hole of claim 1, and further comprising:

the second diffusion section has a cross sectional shape of smooth walls without sharp corners.

8. The film cooling hole of claim 1, and further comprising:

the upstream end of the second diffusion section is formed on the airfoil surface.

9. The film cooling hole of claim 1, and further comprising:

the film cooling hole is aligned in a stream-wise direction of the hot gas flow over the airfoil wall.

10. The film cooling hole of claim 1, and further comprising:

the film cooling hole is aligned in a compound angled direction of the hot gas flow over the airfoil wall.

11. A turbine airfoil for use in a gas turbine engine, the turbine airfoil comprising:

a plurality of film cooling holes of claim 1 to discharge film cooling air onto the surface of the airfoil.

12. A process of forming a film cooling hole in an airfoil used in a gas turbine engine, the process comprising the steps of:

providing for an airfoil with an internal cooling air passage;

cutting a constant diameter metering hole into the airfoil wall using a laser;

cutting a conical shaped first diffusion section adjacent to the metering section using the laser;

cutting a contoured clam shell shaped spreading section adjacent to the first diffusion section using the laser so that the spreading section opens onto the airfoil surface.

13. The process of forming a film cooling hole of claim 12, and further comprising the step of:

cutting the spreading section so that the upstream end of the opening is on the airfoil surface and on the end of the first diffusion section.

14. The process of forming a film cooling hole of claim 12, and further comprising the step of:

cutting the metering hole and the first diffusion section and the spreading section with smooth walls without any sharp corners.

15. The process of forming a film cooling hole of claim 14, and further comprising the step of:

cutting the contoured clam shell shaped spreading section with a downstream wall with a raised middle portion and two depressions formed between the raised middle portion and the two sidewall portions.

16. The process of forming a film cooling hole of claim 14, and further comprising the step of:

cutting the contoured clam shell shaped spreading section with two sidewalls that are slanted outward toward the hole opening.

* * * * *